US005329747A

United States Patent [19]

Williams, Jr.

[11] Patent Number: 5,329,747

[45] Date of Patent: Jul. 19, 1994

[54] METHOD TO ACCESS CARRYING HANDLE ON BUNDLE WRAPPED PREPACKAGED ITEMS

[75] Inventor: Allen C. Williams, Jr., Spartanburg, S.C.

[73] Assignee: W. R. Grace & Co.-Conn., Duncan, S.C.

[21] Appl. No.: 971,372

[22] Filed: Nov. 4, 1992

[51] Int. Cl.[5] ..... B65B 17/02; B65B 53/02; B65B 61/16

[52] U.S. Cl. ..... 53/413; 53/48.2; 53/442; 220/752; 220/906

[58] Field of Search ..... 53/442, 557, 48.2, 48.3, 53/48.1, 134.1, 413, 448, 443; 220/515, 752, 771, 906

[56] References Cited

U.S. PATENT DOCUMENTS 2,976,655 3/1961 Dreyfus et al. ..... 53/42
3,131,810 5/1964 Dreyfus ..... 206/46
3,187,477 6/1965 Dreyfus ..... 53/30
3,206,020 9/1965 Billingsley et al. ..... 53/48.2 X
3,215,266 11/1965 Dreyfus ..... 206/65
3,334,737 8/1967 Dreyfus ..... 206/65
3,353,326 11/1967 Becker ..... 53/48.2 X
3,400,810 9/1968 Makowski ..... 53/48.2 X
3,675,767 7/1972 Taylor ..... 53/48.2 X
3,744,626 7/1973 Dreyfus ..... 206/65

*Primary Examiner*—James F. Coan
*Attorney, Agent, or Firm*—William D. Lee, Jr.; Mark B. Quatt; George Legg

[57] ABSTRACT

This invention relates to a packaging method and device utilizing heat-shrinkable thermoplastic film for bundling a plurality of prepackaged containers which allows for access to a carrying means on the prepackaging. The packaging method and device forms a means of bundling a plurality of containers which have been prepackaged into units. Further, the heat-shrinkable thermoplastic film device forms a protective shielding for the prepackaged containers so bundled.

13 Claims, 1 Drawing Sheet

METHOD TO ACCESS CARRYING HANDLE ON BUNDLE WRAPPED PREPACKAGED ITEMS

BACKGROUND OF THE INVENTION

1. Field of the Invention

This invention relates to a packaging method utilizing heat-shrinkable thermoplastic film for bundling a plurality of prepackaged containers which allows access to a carrying means on the prepackaging. The packaging method forms a means of bundling a plurality of containers which have been prepackaged into units. Further, the heat-shrinkable thermoplastic film forms a protective shielding for the prepackaged containers so bundled.

2. Description of the Related Art

It is now common practice to bundle several prepackaged sets of product containing containers into a single package for transportation, storage and sale. Furthermore, there is the need to bundle containers having unique shapes which do not lend themselves to efficient bundling in paper and pasteboard. The packaging device of the present invention is adaptable for use with containers having a variety of shapes. Further, this packaging device can be used with any prepackaged container shape and size and where the containers are fragile, the bundling film is readily adapted to provide protective shielding for the containers.

The older packaging practice of using paper or pasteboard packaging devices has the disadvantage that these paper and pasteboard devices are bulky, expensive and require complicated machinery. Further, these paper and pasteboard devices are subject to disintegration when exposed to high humidity areas or water. The use of plastic bundling devices overcomes these disadvantages. Additionally, the present invention provides protection against abrasion, dirt and damage to the bundled containers.

A method of covering a container, such as a dish or cup, containing a bulk food item is disclosed in U.S. Pat. No. 2,976,655 issued to Dreyfus et al. A method of packaging individual items in a tube of shrinkable film is disclosed in U.S. Pat. No. 3,131,810 issued to Dreyfus. Packaging a plurality of individual items in a tube of shrinkable film is disclosed in U.S. Pat. Nos. 3,187,477 and 3,334,737 both issued to Dreyfus. A method of packaging a plurality of individual items in a shrinkable film envelope is disclosed in U.S. Pat. No. 3,215,266 issued to Dreyfus. However, none of these disclosures teach a method or device for bundling a plurality of prepackaged items into a single unit. Furthermore, none of these teachings disclose how to provide a means to access the carrying means of the individual packages or containers.

OBJECTS AND SUMMARY OF THE INVENTION

It is an object of this invention to provide a bundling device for packaging a plurality of prepackaged containers which includes a means of accessing the carrying means of the prepackaging without impairing the integrity of the bundling device.

It is a further object of this invention to provide a bundling device which provides shielding for the bundled items from foreign objects.

It is also an object of this invention to provide a bundling device useful for transporting a plurality of prepackaged items.

It is a still further object of the present invention to provide a bundling device which provides visual access to the contents of the bundle without having to remove or destroy the integrity of the bundling device.

It is yet another object of the present invention to provide a bundling device which resists tear propagation of the bundling device around the carrying means access area.

Accordingly, one form of the present invention relates to a method of bundling a plurality of packages having one or more containers therein and providing for access to a carrying means comprising: placing a plurality of packages having one or more containers therein and having a carrying means, in a desired position; surrounding said plurality of packages with a heat-shrinkable thermoplastic film; shrinking said heat-shrinkable thermoplastic film around said plurality of packages using a heat shrinking means; and providing access to the carrying means through the heat-shrinkable film using a hot tool cutting means; characterized in that the hot tool cutting means simultaneously cuts an access hole and provides a weld around the periphery of said access hole thereby substantially eliminating tear propagation in the heat-shrinkable thermoplastic film.

Another form of the present invention relates to a method of bundling a plurality of packages having one or more containers therein and providing for access to a carrying means comprising: placing a plurality of packages having one or more containers therein and having a carrying means, in a desired position; surrounding said plurality of packages with a heat-shrinkable thermoplastic film; providing access to the carrying means through the heat-shrinkable film using a hot tool cutting means; and shrinking said heat-shrinkable thermoplastic film around said plurality of packages using a heat shrinking means; characterized in that the hot tool cutting means simultaneously cuts an access hole and provides a weld around the periphery of said access hole thereby substantially eliminating tear propagation in the heat-shrinkable thermoplastic film.

Yet another form of the invention relates to a packaging device comprising a heat-shrinkable thermoplastic film, heat shrunk around a plurality of prepackaged containers and having a carrying means access means comprising a hole cut into said heat-shrinkable thermoplastic film using a hot tool means and having a weld around the periphery of said access means to substantially eliminate tear propagation.

Preferred forms of the invention, as well as other embodiments, objects, features and advantages of this invention, will be apparent from the following detailed description, and illustrative embodiments thereof, which are to be read in connection with the accompanying drawings.

DESCRIPTION OF THE PREFERRED EMBODIMENTS OF THE INVENTION

Figure 1:
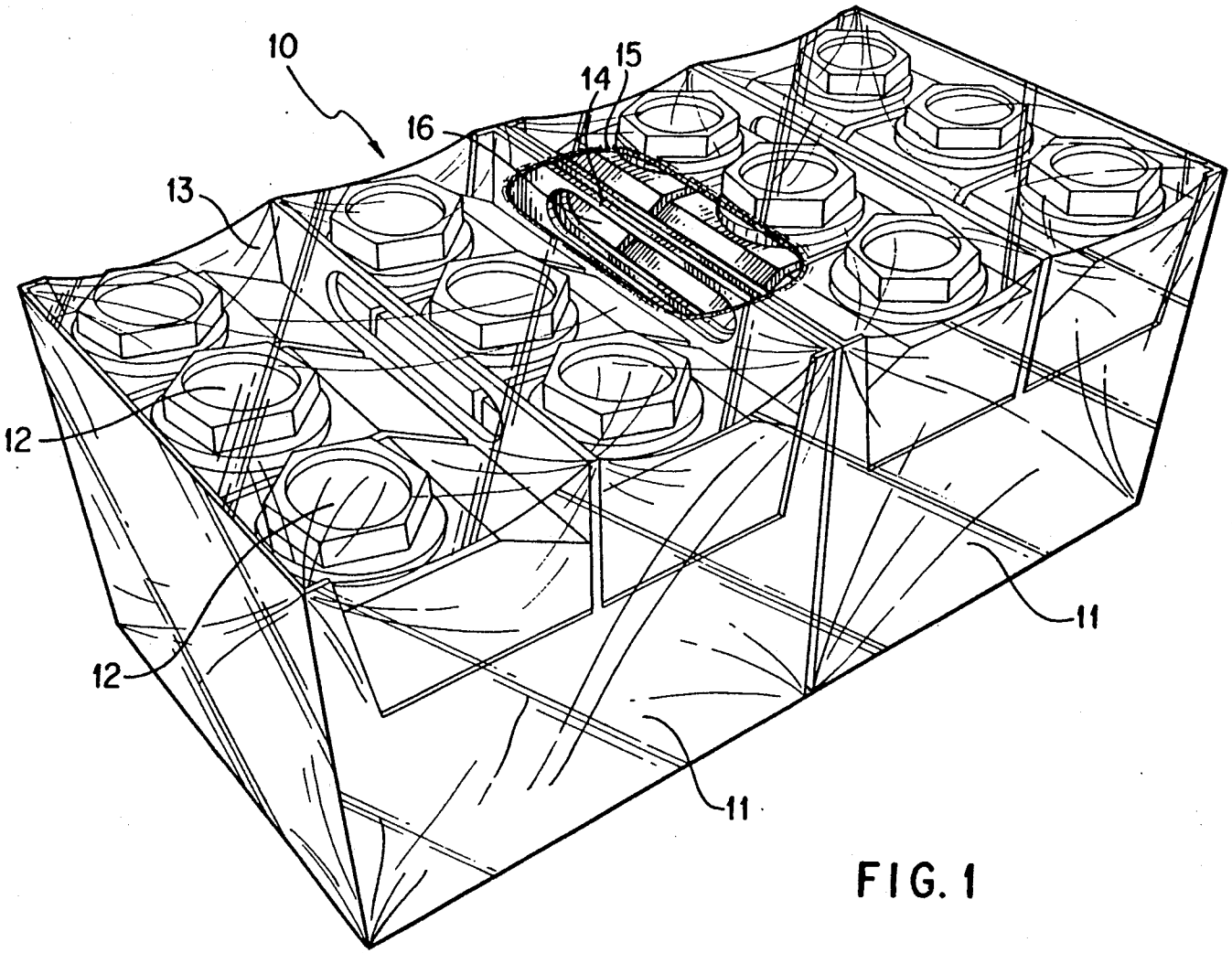
FIG. 1 shows an isometric view of a preferred form of the present invention.

The present invention will be better understood from the specification taken in conjunction with the accompanying drawings in which like reference numerals refer to like parts.

Referring now to FIG. 1, there is shown a bundled set of prepackaged containers 10, comprising two packages 11 having six containers 12 in each package 11, bundled in heat-shrinkable thermoplastic film 13 having a carrying means access hole 14, with welded edge 15, allowing access to carrying means 16 of packages 11.

In practice the packaged containers to be bundled are positioned as desired and a heat-shrinkable film is placed around the positioned packages and heat shrunk as is well understood in the art. A carrying handle access hole is then produced using a hot cutting means and is located to allow access to the carrying means provided on the container packages or on the containers themselves. Alternatively, the carrying handle access hole may be cut before the film is heat shrunk around the packaged containers. The heat-shrinkable film may be in the form of bags, tubes or sheets and is applied and shrunk using methods well known and understood in the art.

In the present invention, a plurality of prepackaged objects are bundled using a heat-shrinkable, thermoplastic film as the sole bundling material. These heat-shrinkable materials may be mono-axially oriented or biaxially oriented, and further may be either mono-layer material or multi-layer material. Suitable heat-shrinkable polymeric film materials, as are well known to those skilled in the art, including, but are not limited to, such materials as heat shrinkable polyolefins, e.g., polypropylene, polyvinyl compounds, e.g., polyvinyl chloride and sarans, polyesters, e.g., polyethylene terephthalate. A preferred suitable material is a bi-axially oriented heat shrinkable thermoplastic film.

The carrying means access hole may be cut using a hot wire, a hot bar or a hot knife cutting means well known by those skilled in the art. This piercing hot knife, hot wire or hot bar is utilized at a temperature exceeding the film's melting point and pierces the film making the access hole. The hot tool cutting means creates a welded edge along the opening which will substantially eliminate the development of film tears and disruption of the package integrity which can occur by cutting with a sharp cutting means without heat.

Although the illustrative embodiments of the present invention have been described herein with reference to the accompanying drawings it is to be understood that the invention is not limited to those precise embodiments, and that various other changes and modifications may be effected therein by one skilled in the art without departing from the scope or spirit of the invention.

What is claimed is:

1. A method of bundling a plurality of packages having one or more containers therein and providing for access to a carrying means comprising:

a) placing a plurality of packages having one or more containers therein and having a carrying means, in a desired position;

b) surrounding said plurality of packages with a heat-shrinkable thermoplastic film;

c) shrinking said heat-shrinkable thermoplastic film around said plurality of packages using a heat shrinking means; and d) providing access to the carrying means through the heat-shrinkable film using a hot tool cutting means;

characterized in that the hot tool cutting means simultaneously cuts an access hole of a size sufficient to permit hand access therethrough and provides a weld around the periphery of said access hole thereby substantially eliminating tear propagation in the heat-shrinkable thermoplastic film.

2. A method as claimed in claim 1 wherein, said step d) is performed before said step c).

3. A method as claimed in claim 1 wherein, said heat-shrinkable thermoplastic film is a mono-axially oriented film.

4. A method as claimed in claim 1 wherein, said heat-shrinkable thermoplastic film is a biaxially oriented film.

5. A method as claimed in claim 1 wherein, said heat-shrinkable thermoplastic film is a mono-layer film.

6. A method as claimed in claim 1 wherein, said heat-shrinkable thermoplastic film is a multi-layer film.

7. A method as claimed in claim 1 wherein, said heat-shrinkable thermoplastic film is selected from the group consisting of heat shrinkable polyolefins, polyvinyl compounds, polyesters, and combinations thereof.

8. A method as claimed in claim 1 wherein, said hot tool means is a hot knife apparatus.

9. A method as claimed in claim 1 wherein, said hot tool means is a hot wire apparatus.

10. A method as claimed in claim 1 wherein, said hot tool means is a hot bar apparatus.

11. The product of the process of claim 2.

12. The product of the process of claim 1.

13. A packaging device comprising a heat-shrinkable thermoplastic film, heat shrunk around a plurality of prepackaged containers and having a carrying means access means comprising a hole cut into said heat-shrinkable thermoplastic film of a size sufficient to permit hand access therethrough using a hot tool means and having a weld around the periphery of said access means to substantially eliminate tear propagation.

* * * * *